US010899592B2

(12) United States Patent
Cenci

(10) Patent No.: US 10,899,592 B2
(45) Date of Patent: Jan. 26, 2021

(54) FILLING UNIT AND METHOD FOR FILLING AN ARTICLE WITH A POURABLE PRODUCT

(71) Applicant: SIDEL PARTICIPATIONS, Octeville-sur-Mer (FR)

(72) Inventor: Mattia Cenci, Parma (IT)

(73) Assignee: Sidel Participations, Octeville-sur-mer (FR)

( * ) Notice: Subject to any disclaimer, the term of this patent is extended or adjusted under 35 U.S.C. 154(b) by 0 days.

(21) Appl. No.: 16/021,107

(22) Filed: Jun. 28, 2018

(65) Prior Publication Data

US 2019/0002262 A1 Jan. 3, 2019

(30) Foreign Application Priority Data

Jun. 30, 2017 (EP) ..... 17305844

(51) Int. Cl.
*B67C 3/12* (2006.01)
*B67C 3/28* (2006.01)
(Continued)

(52) U.S. Cl.
CPC ..... *B67C 3/12* (2013.01); *B67C 3/10* (2013.01); *B67C 3/28* (2013.01); *B67C 2003/228* (2013.01); *B67C 2003/2694* (2013.01)

(58) Field of Classification Search
CPC .... B67C 3/06; B67C 3/08; B67C 3/12; B67C 3/28; B67C 2003/228; B67C 3/02; B67C 3/26; B67C 3/10
(Continued)

(56) References Cited

U.S. PATENT DOCUMENTS 3,006,373 A * 10/1961 Ehlke ..... F16K 31/406 137/625.61
6,026,867 A * 2/2000 Klarl ..... B67C 3/02 141/150
(Continued)

FOREIGN PATENT DOCUMENTS

DE 10 2008 030292 A1 12/2009
EP 2 871 150 A1 5/2015
(Continued)

OTHER PUBLICATIONS

European Search Report from corresponding EP Application No. 17305844.7 dated Dec. 6, 2017 (2 pages).

*Primary Examiner* — Timothy P. Kelly
*Assistant Examiner* — Stephanie A Shrieves

(57) ABSTRACT

Disclosed is a unit for filling articles with a pourable product. The unit includes a tank having pourable product separated from a first aeriforrn; a filling device for filling articles; a first valve, set to an open configuration allowing fluid connection between the pourable product and article or set to a dosed configuration; a first fluidic line fbr allowing escape of a second aeriform from inside articles when first valve is open and article is in contact with filling device; a second valve, set to an open configuration allowing the second aeriform to flow along first fluidic line when first valve is open or set to a dosed configuration; a second fluidic line fluidly connected with first fluidic line; and a third valve arranged along second fluidic line, and which can he selectively arranged to fluidly connect the second fluidic line with an inner volume of a cabinet.

5 Claims, 4 Drawing Sheets

(51) Int. Cl.

| | |
|---|---|
| ***B67C 3/10*** | (2006.01) |
| *B67C 3/26* | (2006.01) |
| *B67C 3/22* | (2006.01) |

(58) Field of Classification Search
USPC ..... 141/6, 129, 144, 145, 153, 392
See application file for complete search history.

(56) References Cited

U.S. PATENT DOCUMENTS

| | | | | |
|---|---|---|---|---|
| 6,192,946 | B1 * | 2/2001 | Clusserath | B67C 3/12 141/40 |
| 2002/0179177 | A1 * | 12/2002 | Tsukano | B67C 3/10 141/57 |
| 2015/0129083 | A1 * | 5/2015 | Bandini | B67C 3/28 141/9 |
| 2017/0158480 | A1 * | 6/2017 | Bandini | B67C 3/2614 |

FOREIGN PATENT DOCUMENTS

| | | | | |
|---|---|---|---|---|
| EP | 3 020 679 | A1 | 5/2016 | |
| EP | 3020679 | A1 * | 5/2016 | B67C 3/06 |
| WO | WO2010000431 | A * | 1/2010 | |
| WO | WO-2010000431 | A1 * | 1/2010 | B67C 3/04 |

* cited by examiner

FILLING UNIT AND METHOD FOR FILLING AN ARTICLE WITH A POURABLE PRODUCT

CROSS-REFERENCE TO RELATED PATENT APPLICATIONS

This application claims the benefit of European Application No. 17305844.7, filed Jun. 30, 2017. The entire contents of the above-referenced application are expressly incorporated herein by reference.

The present invention relates to a filling unit for contact filling an article with a still pourable product, especially a still pourable food product.

The present invention also relates to a filling method for contact filling an article with the still pourable product, especially a still pourable food product.

The present invention also relates to a method of updating a filling unit for contact or contactless filling an article with a pourable product to a filling unit for contact filling article with a still product.

In greater detail, the term "still" indicates that the pourable product does not contain carbon dioxide.

Known article-handling machines comprise a filling station fed with empty articles and adapted to output articles filled with the pourable food product.

The filling unit substantially comprises a carousel conveyor rotating about a rotation axis, a tank containing the pourable food product, and a plurality of filling devices supported by the carousel conveyor in a position radially external with respect to the rotation axis of the carousel conveyor.

In greater detail, the carousel is provided with a plurality of support elements for respective articles provided to arrange the mouths of respective articles in a lower position with respect to the respective filling devices and to displace the articles along a circumferential arc trajectory about the rotation axis integrally to the respective filling devices.

Each filling device essentially comprises a fixed body connected to the carousel and a shutter sliding with respect to the fixed body between an open configuration and a closed configuration.

In greater detail, when it is arranged in the open configuration, the shutter defines an opening with the fixed body. The pourable product thereby flows from the tank to a filling mouth of the relative article passing through the opening.

Differently, when the shutter is arranged in the closed configuration, it sealingly cooperates with an abutment surface defined by the fixed body, thus preventing the pourable product from flowing from tank towards the mouth of the relative article.

In case of contact filling, the mouth of each article is tight-fluid pressed against the body of the respective filling device.

EP-A-2781150 in the name of the same Applicant discloses a filling station with a plurality of filling devices capable of contact or contactless filling a plurality of respective articles.

In the case of contact filling with carbonated food products, the filling device is required to carry out a plurality of additional operations on the articles, in addition to the filling with the pourable food product.

In greater detail, the articles undergo a pressurization operation before the filling thereof with the pourable food product. Still more precisely, the empty articles are filled with a pressurized gas, so as to render the pressure inside the articles equal to the pressure of the pourable product, during the filling operation.

Furthermore, due to the fact that the inner volume of each article is in tight-fluid contact with the body of the respective filling device, the latter is required to allow the gas contained in the articles to escape during the filling of the articles.

In order to meet all these needs, the filling station shown in EP-A-2781150 comprises:

- a tank filled with a pressurization gas and the pourable product;
- a pressurization chamber, which is common to all the filling devices, is fluidly connected with the tank, is fluidly connected with a plurality of first ducts defined by relative filling devices and is connected with an exhaust.
- a return gas chamber, which is common to all the filling devices, is fluidly connected with a plurality of second ducts defined by relative filling devices and is fluidly connected with an exhaust; and
- a de-pressurization chamber, which is common to all the filling devices, is fluidly connected with a plurality of third ducts defined by relative filling devices and is fluidly connected with a drain.

Furthermore, the filling station comprises:

- a plurality of first filling valves, which are interposed along respective first ducts, and can be selectively displaced either in a relative open configuration in which they allow the pressurization gas to flow along relative first ducts or in a relative closed configuration in which they allow that flow along relative first ducts;
- a plurality of second valves, which may be selectively set in respective open configurations in which they allow the gas contained in the inner volumes of respective articles to flow along respective second ducts or in respective closed configurations in which they prevent the gas contained in respective articles from flowing along respective second ducts; and
- a plurality of third valves, which may be selectively set in respective open configurations in which they allow the gas present in the head-spaces of relative articles to be discharged in the drain along relative third fluidic lines or in respective closed configurations in which they prevent the gas present in the head-spaces of relative articles from flowing along relative third fluidic lines to the drain.

In greater detail, each first duct is fluidly connected to the first opening of relative article, in case of contact filling thereof. Thus, each first duct allows the pressurization of the relative article, when relative first valves are in relative open positions and when the relative shutter is in the closed position before the filling of relative article.

Each second duct is fluidly connected to the inner volume of relative article in case of contact filling thereof. Thus, each second duct allows the return of the gas contained in the relative article, when relative second valves are in respective open positions and when the relative shutter is in the open position.

Each third duct is fluidly connected to the inner volume of relative article in case of contact filling thereof. Thus, each third duct allows the escape of the gas contained in the relative articles, when relative third valves are in respective open positions and when the relative shutter is in the open position.

The exhaust and the drain define access points for potentially contaminant agent towards the inner of the filling station and therefore towards the pourable food product intended to fill the articles.

In case of contact filling with carbonated products, the differential pressure between the pressurization chamber and the exhaust as well as between the de-pressurization chamber and the drain prevents the contaminant agents from entering the inner of the filling station.

However, in case of contact filling with still products, the above-identified differential pressure is lower than in case of contact filling with carbonated products.

This is due to the fact that the articles for still products are weaker than the articles for carbonated products, and to the fact that the still products are delicate and their organoleptic properties may be altered by the exposure to a particularly high pressure.

This lower differential pressure might be not enough to prevent the contaminant agents from entering the inner of the filling station.

A need is therefore felt within the industry to modify the known filling station with the aim of rendering them suitable to contact fill still and delicate food products while at the same time preventing any contamination from the outside of the filling station.

It is an object of the present invention to provide a filling station for contact filling of an article with a still pourable product, which allows to easily and cost-effectively meet the above need.

The aforementioned object is achieved by the present invention as it relates to a filling station for contact filling of an article with a still pourable product, as defined in claim 1.

The present invention also relates to a method for contact filling an article with a still pourable product, as defined in claim 10.

The present invention also relates to a method of updating a filling unit for contact on contactless filling an article with a pourable product to a filling unit for contact filling article with a still product, as defined in claim 15.

One preferred embodiment is hereinafter disclosed for a better understanding of the present invention, by way of non-limitative example and with reference to the accompanying drawings, in which.

Figure 1:
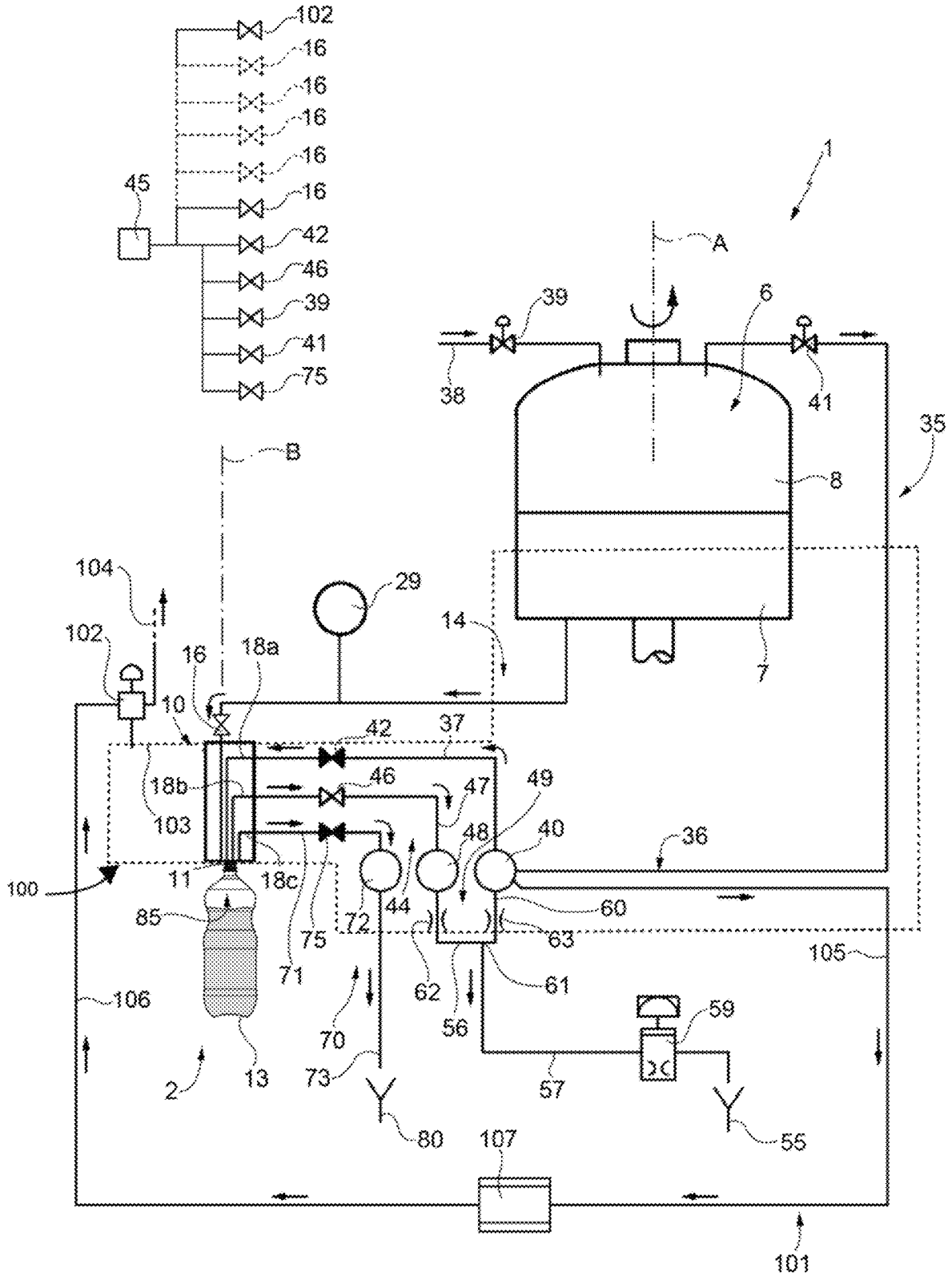
FIG. 1 shows a schematic view of a filling device of the filling unit according to the present invention during a contact filling operation, with parts removed for clarity.
Figure 2:
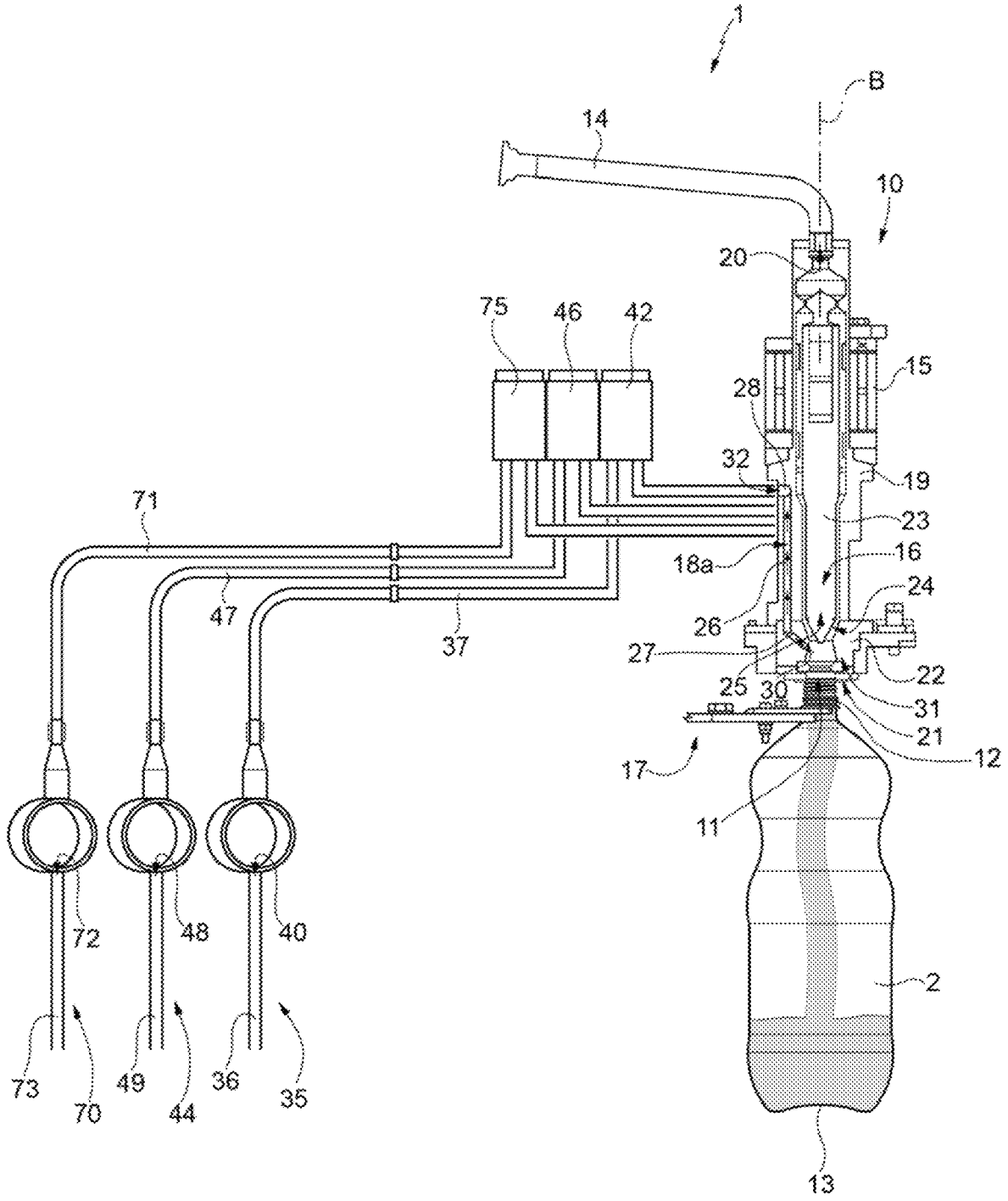
FIG. 2 shows a schematic view of the filling unit of FIG. 1 during the contact filling operation, with parts removed for clarity.

With reference to FIGS. 1 to 4, numeral 1 indicates a filling unit for filling articles 2 with a pourable product.

Filling unit 1 is adapted to contact fill articles 2 with a still product.

Furthermore, filling unit 1 is a update of a filling adapted either to contactless fill article 2 with a still food product or to contact fill article 2 with a carbonated food product, i.e. a food product containing carbon dioxide.

In greater detail, filling unit 1 essentially comprises (FIGS. 3 and 4):

- a carousel 3 rotating about an axis A, which is vertical in the case shown, along an arc-shaped path P extending from an input station I to an output station O; and
- a plurality of filling devices 10 adapted to fill respective articles 2 with the pourable food product and supported by a peripheral edge external to axis A of carousel 3.

Carousel 3 also includes (FIG. 1) a tank 6 common to all filling devices 10 and which comprises a lower portion filled with the pourable food product at a pressure higher than environment pressure and an upper portion 8 filled with a gas.

In particular, gas is a pressurization gas, e.g. air or nitrogen. The gas is flown inside article 2 before the filling thereof, so as to render equal the pressure in the inner volume of articles 2 and the pressure of the pourable product inside portion 7 of tank 6.

Each article 2 comprises (FIGS. 1 and 2):

- a mouth 11 adapted to allow the filling of article 2 by means of filling unit 1 and the following pouring of the food product from article 2;
- a neck 12 arranged immediately below mouth 11; and
- a bottom wall 13 opposite to mouth 11.

For simplicity, the following description will refer to only one filling device 10 and to relative article 2, as devices 10 are identical to one another.

Filling device 10 essentially comprises (FIG. 1):

- a frame 15 fitted to carousel 3;
- a hollow body 19 which is defined by frame 15 and which extends about an axis B parallel to and staggered from axis A;
- a shutter 16 movable along axis B inside body 19; and
- a gripping device 17 movable along axis B towards and away filling device 10 and configured to grip neck 12 of article 2.

Gripping device 17 is movable together and synchronously with filling device 10 and carousel 3 about axis A.

Furthermore, gripping device 17 is movable parallel to axis B between:

- a lowered rest position (not-shown); and
- a raised operative position (FIGS. 1 and 2), in which article 2 undergoes a certain number of operations.

Still more precisely, gripping device 17 moves from the lowered rest position to the raised operative position at station I and moves from the raised operative position to the lowered rest position at station O.

Body 19 comprises, in turn, proceeding along axis B:

- an opening 20, which is fluidly connected with lower portion 7 of tank 6;
- an annular protrusion 22, which protrudes towards axis B and defines a conical passage 24 (shown in FIG. 3);
- an opening 21, which is opposite to opening 20, which faces mouth 11 of article 2 and through which the food product passes during the filling of article 2; and
- a cavity 31 which is interposed along axis B between protrusion 22 and opening 21, and which is bounded, on the opposite side of protrusion 22, by opening 21.

In particular, filling unit 1 comprises, for each filling device 10, a fluidic line 14 interposed between lower portion 7 of tank 6 and openings 20 of filling devices 10, and along which a flow-sensor 29 (shown in FIG. 1), a flow-meter in the embodiment shown, is arranged.

Protrusion 22 is axially interposed between openings 20, 21, proceeding along axis B.

Due to the fact that passage 24 is, in a section orthogonal to axis B, shaped as a circle, the food product creates a cylindrical flow of axis B, during the filling of article 2.

In the embodiment shown, shutter 16 comprises:

- a stem 23 which receives a force along axis B; and
- a plunger 25 which is arranged at an end of stem 23 arranged on the side of opening 21.

Plunger 25 is conical of axis B and comprises a conical end on the side of opening 21 shaped correspondingly to the shape of opening 21.

Furthermore, protrusion 22 is conical of axis B and tapers from opening 20 to opening 21.

Shutter 16 is movable relative to body 19 and along axis B between:

- an open configuration (shown in FIG. 2), in which it allows the fluidic connection between lower portion 7 of tank 6 and opening 21, thus allowing the filling of article 2 with the food product; and
- a closed configuration (not shown), in which it prevents the fluidic connection between lower portion 7 of tank 6 and opening 21.

In the present description, the expression contact filling indicates a filling modality, in which article 2 is tight-fluidly pressed against body 19 of filling device 10 whereas the expression contactless filling indicates a filling modality, in which article 2 is spaced along axis B from body 19 of filling device 10.

In this way, the food product is prevented from contacting the outer environment in case of contact filling whereas the food product contacts the outer environment in case of contactless filling.

In the embodiment shown, when shutter 16 is in the open configuration, plunger 25 is spaced from protrusion 22 and leaves free passage 24.

On the contrary, when shutter 16 is in the closed configuration, plunger 25 abuts against protrusion 22 and seals passage 24.

Furthermore, mouth 11 of article 2 is tight-fluidly pressed against opening 21 of filling device 10 in case of contact filling, when gripping device 17 is in the raised position.

On the contrary, mouth 11 of article 2 is spaced along axis B from opening 21 of filling device 10 in case of contactless filling, when gripping device 17 is in the raised position.

Figure 3:
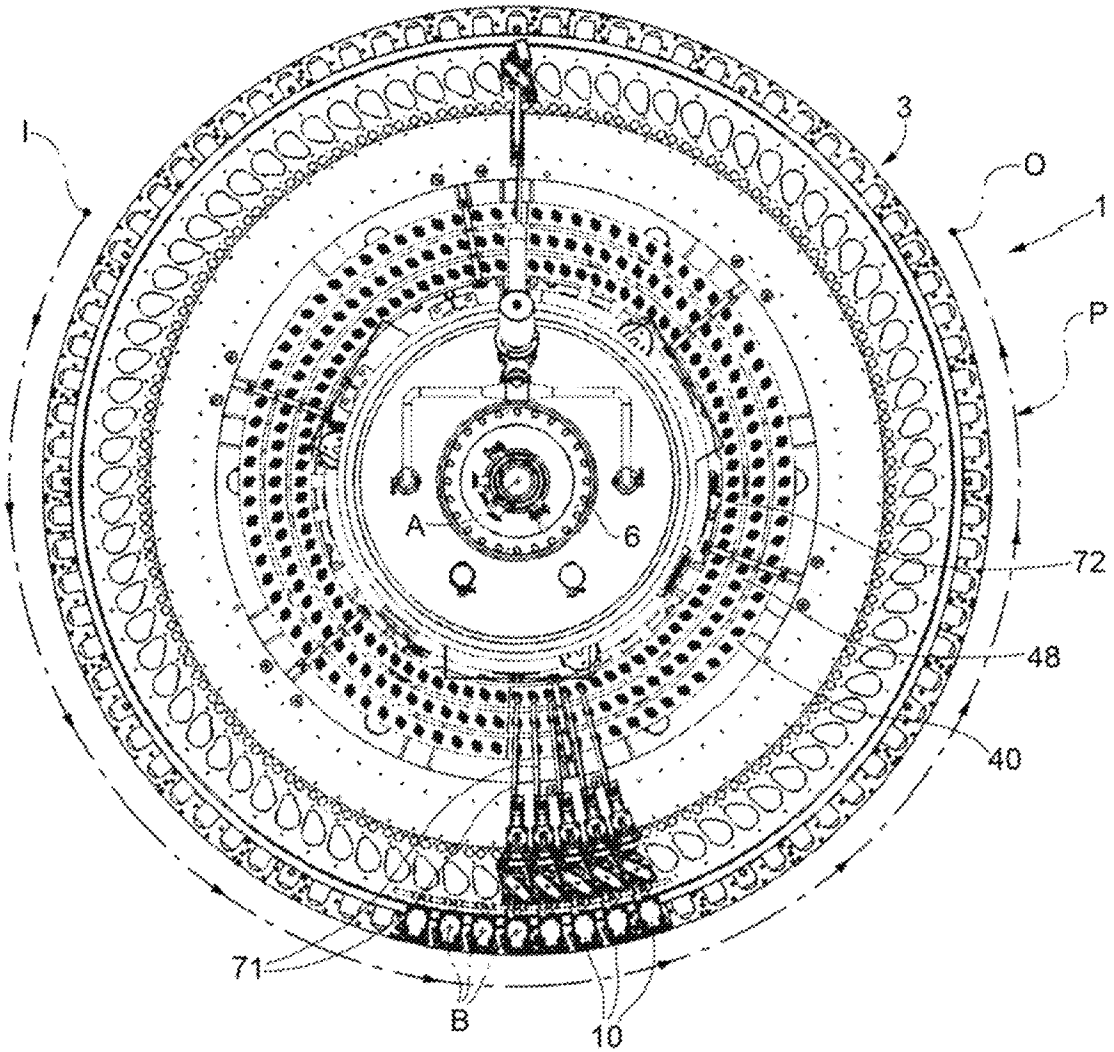
FIG. 3 is a top view of the filling unit of FIGS. 1 and 2.
Figure 4:
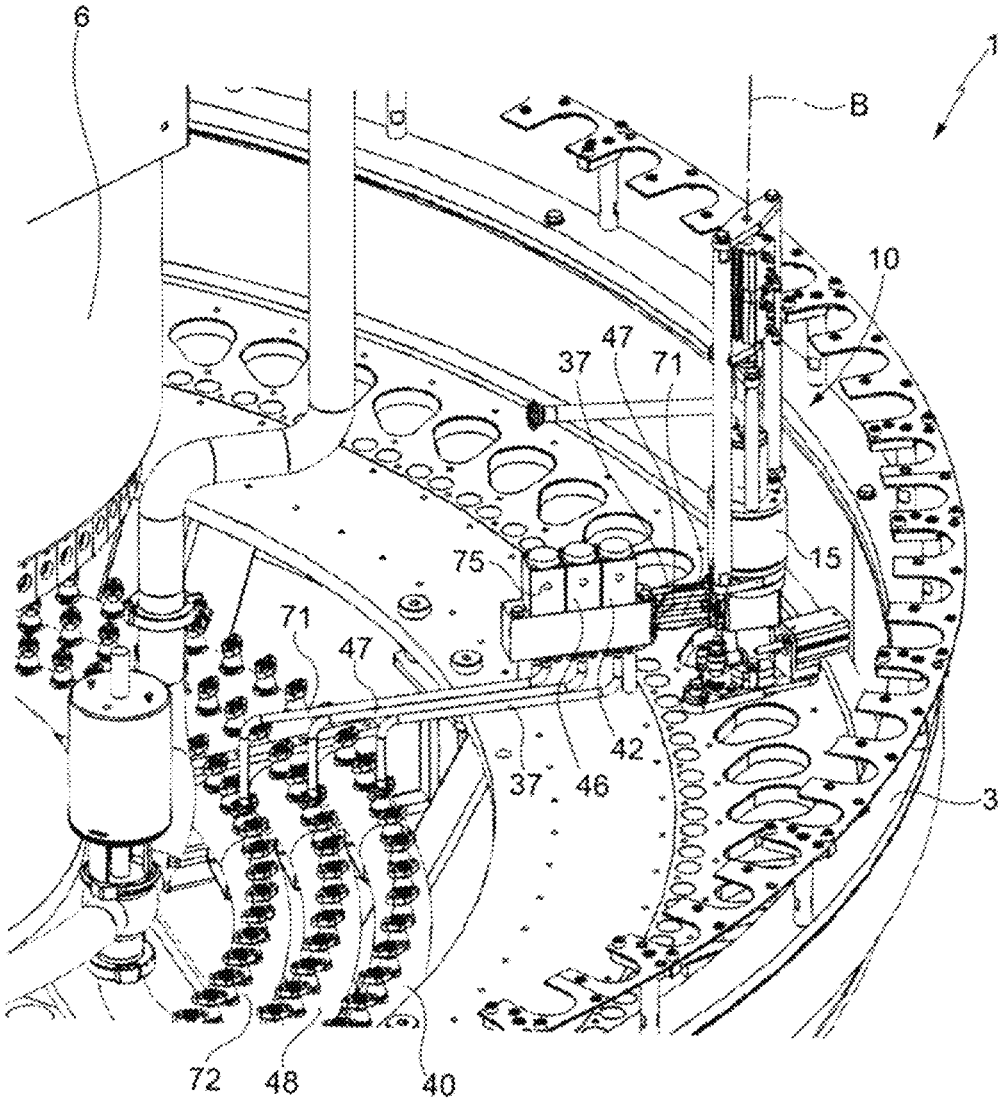
FIG. 4 is a perspective view of the filling unit of FIGS. 1 to 3, with parts removed for clarity.

Body 19 also comprise a plurality, three in the embodiment shown, of ducts 18*a*, 18*b*, 18*c* (only schematically shown in Figure), which extend eccentrically to and on one side only of axis B and are arranged radially outer than shutter 16 with respect to axis B (see FIGS. 3 and 4).

In detail, each duct 18*a*, 18*b*, 18*c* comprises a relative end opening 30. Openings 30 open inside body 19 in a position axially interposed along axis B between protrusion 22 and opening 21, i.e. inside cavities 31.

In this way, openings 30 are in fluid connection with mouth 11 of article 2, even when shutter 16 is in the closed configuration.

In the embodiment shown, each duct 18*a*, 18*b*, 18*c* comprises:

- a main portion 26 extending parallel to axis B;
- an end portion 27, which is housed inside protrusion 22 and defines opening 30; and
- an end portion 28, which is opposite to portion 26 and defines an opening 32, the function of which will be explained in the following of the present description.

Portion 27 converges towards axis B on the opposite side of portion 26, in the embodiment shown.

Portion 28 is, in the embodiment shown, radial to axis B.

Filling unit 1 also comprises (FIG. 1) a plurality of fluidic lines 35, which are adapted to selectively convey the pressurization gas from upper portion 8 of tank 6 inside the inner volume of relative articles 2, in case of contact filling.

Still more precisely, fluidic lines 35 comprise:

- a common portion 36, which originates from portion 8 of tank 6 and which is common to all filling devices 10;
- a pressurization chamber 40, which is common to all filling devices 10;
- relative portions 37, which are associated to respective filling devices 10 and interposed between chamber 40 and openings 32 of relative duct 18*a*; and
- relative ducts 18*a* associated to respective filling devices 10, which are in fluidic connection with the inner volumes of respective articles 2, when respective gripping devices 17 are in the relative raised operative positions.

Filling unit 1 also comprises:

- a valve 41 common to all the filling devices 10 and interposed along portion 36 of filling lines 35 between upper portion 8 and chamber 40; and
- a plurality of valves 42 associated to relative filling devices 10 and interposed, each, along portion 37 of relative fluidic line 35.

Valve 41 is a modulating valve and may be selectively arranged in:

- a plurality of open configurations, in which it allows the gas contained in upper portion 8 of tank 6 to flow along portion 36 and towards chamber 40; and
- a closed configuration, in which it prevents the gas contained in upper portion 8 of tank 6 from flowing along portion 36 and towards chamber 40.

The configuration of valve 41 determines the differential pressure between the product contained in portion 7 and the inner volume of article 2, i.e. the environmental pressure. This differential pressure causes the flow of the pourable product along fluidic line 14 when valve 10 is in the open position.

This differential pressure is maximum when valve 41 is in the closed configuration and decreases as valve 41 is opened.

This differential pressure substantial equals the sum of the pressure inside portion 8 of tank 6 and of the hydraulic head of pourable product inside portion 7 of tank 6.

Each valve 42 may be selectively arranged in:

- an open configuration, in which it allows the gas contained in upper portion 8 of tank 6 to flow from chamber towards relative duct 18*a* and, therefore, relative article 2; and
- a closed configuration, in which it prevents the gas contained in upper portion 8 of tank 6 from flowing from chamber 40 towards relative duct 18*a* and, therefore, relative article 2.

Filling unit 1 also comprises a control unit 45 (only schematically shown in FIG. 1) configured to valves 41, 42 and shutters 16 of filling device 10 in such a way to pressurize articles 2 with gas contained in upper portion 7 of tank 6, before the contact filling of articles 2 with still food product.

To this end, control unit 45 is configured to:

- keep shutters 16 of each filling device 10 in respective closed configuration; and
- set valves 41, 42 in respective open configurations, so as to allow the gas contained in upper portion 8 of tank 6 to flow along fluidic lines 35 and to reach openings 20 and mouths 11 of articles 2 to be filled.

Filling unit 1 also comprises (FIGS. 1 and 2):

- a duct 38 for feeding upper portion 8 of tank 6 with the gas; and
- a valve 39 arranged along duct 38 upstream of tank 6 and controllable to adjust the amount of gas which enters tank 6.

Filling unit 1 comprises, for each filling device 10 and corresponding article 2:

a plurality of fluidic lines 44 for allowing the escaping of the gas contained inside respective articles 2 during the contact filling thereof, which are distinct from fluidic lines 35, and extends from inner volume of article 2 to chamber 40; and a plurality of valves 46, which may be selectively set in respective open configurations in which they allow the gas contained in the inner volumes of articles 2 to flow along respective fluidic lines 44 or in respective closed configurations in which they prevent the gas contained in articles 2 from flowing along respective fluidic lines 44.

Control unit 45 is programmed to set shutter 16 of each filling device 10 in the respective open configuration and respective valve 46 in the respective open configuration during the contact filling of respective article 2, so as to allow the gas contained in article 2 to be discharged during the filling of article 2.

In greater detail, during the contact filling of articles 2, each fluidic line 35 is fluidly isolated from corresponding fluidic line 44, i.e. the gas coming out from each article 2 along respective fluidic line 44 is prevented from reaching corresponding fluidic lines 35.

As it will be evident from the following of the present description, fluidic lines 35, 44 are not required to be physically isolated from one another, but a preferential flow of the gas contained in upper portion 8 of tank 6 is established (as indicated by arrows in FIG. 1):

from portion 8 of tank 6 towards inner volume of articles 2 along respective fluidic lines 35 before the contact filling of articles 2; and from inner volume of articles 2 towards discharge 55 and along respective fluidic lines 44 during the contact filling of articles 2.

In greater detail, fluidic lines 44 comprises, proceeding from the inner volume of relative articles 2 towards discharge 55:

relative ducts 18*b* of respective filling device 10 and which are in fluidic communication with the inner volume of relative articles 2, during the contact filling of articles 2;

relative portions 47 associated to respective filling devices 10 and which originate from openings 32 of relative ducts 18*b;* a return gas chamber 48, which is common to all filling devices 10; and a portion 49, which is common to all filling devices and which extends from return gas chamber 48 to pressurization chamber 40.

Each valve 46 is, in the embodiment shown, interposed along a relative portion 47 of the corresponding fluidic line 44.

Portion 49 comprises, as of return gas chamber 48:

a segment 56 which extends from return gas chamber 48 to connection point 61;

a segment 57 which extends from connection point 61 to a discharge 55 distinct from tank 6; and a duct 60, which is interposed between pressurization chamber 40 and a connection point 61.

Filling unit 1 also comprises a modulating valve 59 which is interposed along portion 49 and adapted to generate a counter-pressure at the end of segment 57.

Furthermore, filling unit 1 comprises:

a plurality of fluidic lines 70; and a plurality of valves 75 interposed along respective fluidic lines 70, and which are normally set in respective closed configurations in which they prevent the gas present in the head-spaces 85 of relative articles 2 from flowing along relative fluidic lines 70 to a drain 80.

In detail, each fluidic line 70 extends between opening 32 of duct 18*c* to a drain 80 at the atmospheric pressure.

Fluidic lines 70 comprise, proceeding from opening 30 of ducts 18*c* to drain 80:

respective ducts 18*b* defined by respective filling devices 10 and which are in fluidic connection with the head space of relative articles 3, in case of contact filling;

respective portions 71 associated to respective filling devices 10 and starting from respective openings 32 of ducts 18*c;* a chamber 72, which is common to all filling devices 10; and a portion 73, which is common to all filling devices 10 and which extends from chamber 72 to drain 80.

Valves 75 are interposed between ducts 18*c* and respective portions 71.

Control unit 45 is programmed for keeping valves 75 in respective closed configurations.

In the embodiment shown, pressurization chamber 40, return gas chamber 48 and chamber 72 are annular about axis A.

Finally, in the embodiment shown, valves 42, 46, 75 are on-off valves.

Advantageously, filling unit 1 comprises:

a cabinet 100 (only schematically shown in FIGS. 1 and 2), which encloses an inner volume 103 defining a sterile environment; and a fluidic line 101 (only schematically shown in FIGS. 1 and 2) fluidly connected with fluidic line 44; and a valve 102 (only schematically shown in FIGS. 1 and 2) arranged along fluidic line 101, and which can be selectively arranged in a first position in which it fluidly connects fluidic line 101 with inner volume 103.

In particular, valve 102 is arranged in the first position, when filling unit 1 is in an operative condition.

The expression "operative condition" indicates in the present description a condition of filling unit 1 during which filling unit 1 is active in contact filling articles 2 with still product.

Inner volume 103 preferably encloses at least in part filling devices 10, tank 6 and fluidic lines 35, 44 and 70.

Modulating valve 59 is kept closed when valve 102 in the first position. In this way, the return gas coming out from articles 2 cannot escape from discharge 55 and is forced to move from chamber 48 to chamber 40 and from chamber 40 to fluidic line 101.

Furthermore, valve 102 can be also selectively set in a second position, in which it fluidly connects fluidic line 101 with a fluidic line 104 (only partly shown in FIG. 1).

Valve 102 is set in the second position, when filling unit 1 is in a further not operative condition.

The expression "not operative condition" indicates a condition of filling unit 1 during which it is idle and does not contact fill article 2 with still product. An example of "not operative condition" is a cleaning operation of filling unit 1.

In greater detail, fluidic line 104 is connected to chamber 40.

Still more precisely, fluidic line 104 is directly connected to chamber 40 and opens inside chamber 40.

Preferably, fluidic line 104 comprises:

a portion 105, which rotates about axis A integrally with filling devices 10 and tank 6 and opens inside chamber 40; and a portion 106, which is stationary about axis A and along which valve 102 is interposed.

Furthermore, filling unit 1 comprises a manifold 107 interposed between portions 105, 106 so as to allow a fluid connection between rotating portion 105 and stationary portion 106.

The operation of filling unit 1 will be described with reference to the contact filling operation with a still product and with reference to only one filling device 10 and respective only one article 2 and only one gripping device 17, and to only one respective filling line 35, 44, 70 (FIG. 1).

The operation of filling unit 1 will be also described starting from a condition in which:

- valve 102 is set in the first position, in which it fluidly connects fluidic lines 102, 104 with one another;
- the configuration of valve 41 is controlled by control unit 45 on the basis of the nature, e.g. the viscosity, of the pourable product, so as to achieve a desired differential pressure between the portion 7 of tank 8 and the inner volume of article 2;
- valve 59 is kept in the closed position by control unit 45, so as to fluidly isolate discharge 55 from the rest of fluidic line 44; and
- valves 72 are set in respective closed configurations.

Portion 8 of tank 6 is filled with a pressurization gas, while portion 7 of tank 6 is filled with the food product with which article 2 will be filled. In particular, the pressure of the food product inside portion 7 of tank 6 is greater than the environment pressure.

Carousel 3 is fed with empty article 2 at inlet station I, advances it along path P along which article 2 is filled with the carbonated food product and discharges the filled article 2 at outlet station O.

Gripping device 17 synchronously rotates about axis B integrally with filling device 10.

Still more precisely, gripping device 17 grips neck 12 of article 2 and moves from the lowered position to raised position at station I, and from the raised position to the lowered position at station O.

When article 2 is in the raised position, mouth 11 of article 2 is sealingly pressed against body 19 of filling device 10. Accordingly, mouth 11 is fluidly connected to opening 21 of filling device 10 and with openings 32 of ducts 18*a*, 18*b*, 18*c*.

As it moves along path P, filling device 10 carries out on article 2 the subsequently following operations:

- pressurization of empty article 2 with the pressurized gas so as to create a minimum differential pressure between the inner volume of article 2 and the outer environment; and
- filling of article 2 with the food product.

In greater detail, when filling device 10 is at station I, control unit 45 sets valve 41 in the open configuration and sets shutter 16 and valves 42, 46 and 75 in respective closed configurations.

During the pressurization step, control unit 45 sets valve 42 in the open configuration, thus allowing the pressurizing gas contained in portion 8 of tank 6 to flow along fluidic line 35.

In greater detail, the pressurizing gas flows from portion 8 to pressure chamber 40 along portion 36 of fluidic line 35, and from pressure chamber 40 to opening 30 of ducts 18*a* along portion 37 and duct 18*a* of the fluidic line 35.

Due to the fact that opening 30 of duct 18*a* and the inner volume of article 2 are in fluidic connection with cavity 31, when shutter 16 is in the closed configuration and mouth 11 of article 2 is pressed against body 19 of filling device 10, the pressurizing gas can fill and pressurize the inner volume of article 2.

When the pressurization of the inner volume of article 2 has been completed, control unit 45 sets valves 41, 42 in the closed configuration, and sets valve 46 and shutter 16 of filling device 10 in the respective open configuration.

In this way, the food product can flow through passage 24 and opening 21 inside the inner volume of article 2, thus filling the latter.

At the same time, the gas contained inside the inner volume of article 2 passes through fluidic line 44 and reaches chamber 48 through duct 60.

Due to the fact that modulating valve 59 is kept closed during the normal operation of filling unit 1, the gas contained inside the inner volume of article 2 is forced to reach chamber 40 and fluidic line 101, without flowing along portion 49 and reaching discharge 55.

Thanks to the fact that valve 102 is in the first configuration, the gas contained in the inner volume of article 2 is discharge inside cabinet 103 into the sterile environment.

When sensor 29 has detected that the desired amount of pourable product has filled article 2, control unit 45 sets shutter 16 and valve 42 in the closed configuration.

In case filling unit 1 is to be switched to a different operative conditions in which the filling of articles 2 is no longer carried out, e.g. a cleaning operative condition, control unit 45 sets valve 102 in a further position, in which it fluidly connects fluidic line 101 with fluidic line 104 outside cabinet 100.

From an analysis of the features of filling unit 1 and of the method according to the present invention, the advantages it allows to obtain are apparent.

In particular, fluidic line 44 allows the escape of the gas during the contact filling of articles 2 is in fluidic connection with fluidic line 101. In this way, the gas is discharged, by means of valve 102, inside cabinet 100.

Due to the fact that cabinet 100 defines an enclosed sterile environment, the contaminant agents are preventing from entering articles 2 and tank 6 and, therefore, from contaminating the pourable product contained therein.

Filling unit 1 therefore allows to contact fill articles 2 with particularly delicate pourable product having organoleptic properties which could be affected by the contaminating agents, even though the differential pressure between fluidic line 44 and the pressure in inner volume 103 is smaller than the differential pressure normally existing in case of contact filling of carbonated products.

Furthermore, valve 41 is a modulating valve and can be controlled by control unit 45 to adjust the amount of gas which flows along fluidic line 35.

In this way, it is possible to establish a desired differential pressure between portion 8 of tank 6 and the inner volume of article 2, so as to fill articles 2 also with particularly viscous food product. This differential pressure substantial equals the sum of the pressure inside portion 8 of tank 6 and of the hydraulic head of pourable product inside portion 7 of tank 6.

Filling unit 1 allows an easy update of a filling unit, as e.g. the one shown in EP-A-2781150, adapted to either contact fill articles 2 with carbonated food product or to contactless fill articles 2 with still food product.

As a matter fact, the update only requires to provide cabinet 100, fluidic line 101 connected to chamber 40 and valve 102 interposed along fluidic line 101.

Finally, it is apparent that modifications and variants not departing from the scope of protection of the claims may be made to filling unit 1 and to the method disclosed herein.

In particular, chamber 40 can be used as return gas chamber and chamber 48 can be used as pressurization gas chamber.

Alternatively, chamber 40 (or 48) can be used both as return gas and as pressurization chamber. In this case, valve 46 (or 42) would be kept closed both during pressurizing and filling step.

Furthermore, filling unit 1 could not comprise loss 62 or not comprise loss 63.

The invention claimed is:

1. A method of filling an article with a pourable product by using a filling unit which comprises: a tank having a first region fillable with the pourable product and a second region tillable with a first gas: at least one filling device for filling the article; at least one first valve configured to move between a first open configuration to allow fluid communication between the first region of the tank and the article, so as to fill the article with the pourable product, and a first closed configuration to prevent fluid communication between the first region of the tank and the article; at least one first fluidic line at least partially defined by the filling device for allowing the escape of a second gas contained inside the article when the first valve is, in use, in the first open configuration and the article is in contact with the filling device; at least one second valve configured to move between a second open configuration to allow the second gas to flow along the first fluidic line, and a second closed configuration to prevent the second gas from flowing along the first fluidic line; the method comprising:

fluidly connecting the first fluidic line with a second fluidic line;

selectively arranging a third valve arranged along the second fluidic line in a third open configuration fluidly connecting the second fluidic line with an inner volume of a cabinet defining a sterile environment;

fluidly connecting the second region of the tank with an inner volume of the article via at least a third fluidic line at least partially defined by the filling unit;

allowing the flow of the first gas along the third fluidic line via at least one fourth valve, when said the first valve is set in the first closed configuration, so as to pressurize the inner volume of the article with the first gas contained inside tank;

preventing the flow of the first gas along the third fluidic line via the fourth valve, when the first valve is set in said the first open configuration;

fluidly connecting a first chamber with the first fluidic line;

interposing a second chamber between the tank and the fourth valve and adapted to be filled, in use, with the first gas contained in the tank;

fluidly connecting the second chamber with the first chamber by a segment extending outside said the tank;

fluidly connecting the second fluidic line with the second chamber so that the second fluidic line directly opens inside said the second chamber; and fluidly connecting the second fluidic line with a fourth fluidic line and fluidly disconnecting the second fluidic line from the inner volume of the cabinet, when the filling unit is not in an operative condition, wherein selectively arranging the third valve in the third open configuration is carried out during an operative condition of the filling unit.

2. The method of claim 1, further comprising:

fluidly connecting an exhaust with the first fluidic line;

arranging a sixth valve along the first fluidic line; the sixth valve being selectively configured to move between a sixth open configuration and a sixth closed configuration;

allowing, when the sixth valve is set in the sixth open configuration, the flow of the second gas along the first fluidic line and up to the exhaust;

preventing, when the sixth control valve is set in the sixth closed configuration, the flow of the second gas along the first fluidic line and up to the exhaust; and setting the sixth valve in the sixth closed configuration when the first valve is set in the first open configuration.

3. The method of claim 1, further comprising interposing a fifth valve between the second region of the tank and the first chamber.

4. The method of claim 1, wherein the filling unit is a contact filling unit in which the article is engaged in a fluid tight connection with the filling device during a filling operation.

5. The method of claim 4, wherein the filling unit is configured to fill the article with a still pourable product.

* * * * *